US010967536B2

(12) United States Patent
Gass et al.

(10) Patent No.: US 10,967,536 B2
(45) Date of Patent: Apr. 6, 2021

(54) BLADE GUARD FOR A TABLE SAW

(75) Inventors: Stephen F. Gass, West Linn, OR (US); James F. W. Wright, Sherwood, OR (US)

(73) Assignee: SawStop Holding LLC, Tualatin, OR (US)

( * ) Notice: Subject to any disclaimer, the term of this patent is extended or adjusted under 35 U.S.C. 154(b) by 0 days.

(21) Appl. No.: 13/385,415

(22) Filed: Feb. 17, 2012

(65) Prior Publication Data

US 2012/0216665 A1 Aug. 30, 2012

Related U.S. Application Data

(60) Provisional application No. 61/463,557, filed on Feb. 17, 2011.

(51) Int. Cl.

| | |
|---|---|
| ***B27B 5/29*** | (2006.01) |
| ***B27G 19/02*** | (2006.01) |
| ***B27G 19/08*** | (2006.01) |
| ***B27G 19/10*** | (2006.01) |

(52) U.S. Cl.

CPC ..... *B27B 5/29* (2013.01); *B27G 19/02* (2013.01); *B27G 19/08* (2013.01); *B27G 19/10* (2013.01); *Y10T 29/49815* (2015.01); *Y10T 83/2077* (2015.04); *Y10T 83/732* (2015.04); *Y10T 83/773* (2015.04); *Y10T 83/7734* (2015.04); *Y10T 83/96* (2015.04)

(58) Field of Classification Search

CPC ..... B27G 19/02; B27G 19/08; B27G 19/10; B27B 5/29; Y10T 83/2077; Y10T 83/732; Y10T 83/773; Y10T 83/7734; Y10T 83/96

USPC ..... 83/478, 102.1, 440.2, 477.2, 860; 144/251.1

See application file for complete search history.

(56) References Cited

U.S. PATENT DOCUMENTS

| | | | |
|---|---|---|---|
| 162,814 | A | 5/1875 | Graves et al. |
| 264,412 | A | 9/1882 | Kuhlmann |
| 299,480 | A | 5/1884 | Kuhlman et al. |
| 307,112 | A | 10/1884 | Groff |
| 545,504 | A | 9/1895 | Hoover |
| 713,196 | A | 11/1902 | Bennett |
| 997,720 | A | 7/1911 | Troupenat |
| 1,037,843 | A | 9/1912 | Ackley |
| 1,082,870 | A | 12/1913 | Humason |

(Continued)

FOREIGN PATENT DOCUMENTS

| | | |
|---|---|---|
| DE | 3137732 | 9/1983 |
| DE | 8807584 | 9/1988 |

(Continued)

OTHER PUBLICATIONS

*The INCA Woodworking Machinery Handbook—With Useful Tips and Jigs for Everyone, INCA Maschinen*, 1984.

(Continued)

*Primary Examiner* — Clark F Dexter

(57) ABSTRACT

Blade guards for table saws are disclosed. The blade guards can be used in a configuration where the guard holds a work piece against a work surface. This may be thought of as blade guards with hold-down capability. The blade guards also include splitters and anti-kickback assemblies. The anti-kickback assemblies include anti-kickback pawls that can be in an operable configuration or a disabled configuration.

12 Claims, 15 Drawing Sheets

(56) References Cited

U.S. PATENT DOCUMENTS

| | | | | |
|---|---|---|---|---|
| 1,148,169 | A | 7/1915 | Howe | |
| 1,244,187 | A | 10/1917 | Frisbie | |
| 1,496,212 | A | 6/1924 | French | |
| 1,511,797 | A | 10/1924 | Berghold | |
| 1,552,553 | A | 9/1925 | Georgia | |
| 1,563,317 | A | 12/1925 | Auel | |
| 1,774,521 | A | 9/1930 | Neighbour | |
| 2,007,887 | A | 7/1935 | Tautz | |
| 2,075,282 | A | 3/1937 | Hedgpeth | |
| 2,095,330 | A | 10/1937 | Hedgpeth | |
| 2,121,069 | A | 6/1938 | Collins | |
| 2,352,235 | A | 6/1944 | Tautz | |
| 2,466,325 | A | 4/1949 | Ocenasek | |
| 2,572,326 | A | 10/1951 | Evans | |
| 2,593,596 | A | 4/1952 | Olson | |
| 3,808,932 | A * | 5/1974 | Russell | B27G 19/02 83/440.2 |
| 3,880,032 | A * | 4/1975 | Green | 83/102.1 |
| 4,453,112 | A | 6/1984 | Sauer et al. | |
| 4,721,023 | A | 1/1988 | Bartlett et al. | |
| 5,116,249 | A | 5/1992 | Shiotani et al. | |
| 5,123,317 | A | 6/1992 | Barnes, Jr. et al. | |
| 5,230,269 | A | 7/1993 | Shiotani et al. | |
| 5,231,906 | A | 8/1993 | Kogej | |
| 5,857,507 | A | 1/1999 | Puzio et al. | |
| 6,131,629 | A | 10/2000 | Puzio et al. | |
| 6,736,042 | B2 | 5/2004 | Behne et al. | |
| 6,796,208 | B1 | 9/2004 | Jorgensen | |
| 7,000,515 | B2 | 2/2006 | Jorgensen | |
| 7,437,981 | B2 | 10/2008 | Burke et al. | |
| 2001/0035081 | A1 | 11/2001 | Sutton | |
| 2002/0117037 | A1 | 8/2002 | Satori | |
| 2004/0226424 | A1 | 11/2004 | O'Banion et al. | |
| 2004/0255745 | A1 | 12/2004 | Peot et al. | |
| 2005/0235793 | A1 | 10/2005 | O'Banion et al. | |
| 2007/0000366 | A1 | 1/2007 | Peot et al. | |
| 2007/0056416 | A1 | 3/2007 | Shibata | |
| 2007/0113714 | A1 | 5/2007 | Burke et al. | |
| 2007/0113715 | A1 | 5/2007 | Burke et al. | |
| 2007/0163408 | A1 | 7/2007 | Buck et al. | |
| 2007/0186739 | A1 | 8/2007 | Peot et al. | |
| 2007/0186741 | A1 | 8/2007 | Buck et al. | |
| 2007/0277661 | A1 | 12/2007 | Domeny et al. | |
| 2008/0022827 | A1 | 1/2008 | Weir et al. | |
| 2009/0044673 | A1 | 2/2009 | Liu et al. | |
| 2010/0147125 | A1 | 6/2010 | Stellman | |

FOREIGN PATENT DOCUMENTS

| | | |
|---|---|---|
| DE | 4205965 C1 | 7/1993 |
| DE | 9306198 | 8/1993 |
| WO | WO 03/006213 | 1/2003 |

OTHER PUBLICATIONS

SI16WA-WF Circular Saw with Tilting Blade Spare Parts Catalogue, SCMI Corporation, Norcross, GA, Nov. 1986 and 1991.
Inca 2200 Table Saw Photo of Internal Mechanisms, around 1992.
Inca 2100SE Blade Guard Photos, 1992.
Inca 2100SE Professional Tablesaw Owners Manual, Injecta Machinery, 1992.
Skil Model 3400-Type 1 10" Table Saw Parts List and Technical Bulletin, S-B Power Tool Company, Jun. 1993.
SI320 Circular with Tilting Blade Spare Parts Catalogue, SCM, Dec. 23, 1998.
SI3200/3800 Circular with Tilting Blade Spare Parts Catalogue, SCM, Dec. 23, 1998.
Grizzly Industrial, Inc. Heavy-Duty 12" Table Saw Model G5959 and G9957 Parts List, 1998 and Oct. 2001.
Altendorf publication, Wilhelm Altendorf GmbH & Co. KG, Minden, Germany, 1999.
SI300N Circular with Tilting Blade Spare Parts Catalogue, SCM, Jun. 12, 2000.
Bosch Model 4000 Worksite Table Saw Operating/Safety Instructions, S-B Power Tool Company, Jul. 2000.
Two photographs of a saw displayed at a trade show on Aug. 23, 2000.
SI400N Circular with Tilting Blade Spare Parts Catalogue, SCM, Sep. 19, 2000.
DeWalt Woodworker's Table Saw DW746 Instruction Manual, DeWalt Industrial Tool Co., 2000.
SC 3W Circular Saw Manual, SCM Group S.p.A Divisione Minimax—Samco, Feb. 2001.
Ryobi 10" Table Saw BT3000 Operator's Manual, Ryobi Technologies, Inc., Mar. 2001.
SI450E Circular with Tilting Blade Spare Parts Catalogue, SCM, Apr. 26, 2001.
Bosch 10" Table Saw Model 0601476139 Parts List and Technical Bulletin, S-B Power Tool Company, Apr. 2001.
Powermatic 10" Tilting Arbor Saw Model 66 Instruction Manual & Parts List, JET Equipment & Tools, Jun. 2001.
Skil Model 3400 Table Saw Operating/Safety Instructions, S-B Power Tool Co., Sep. 2001.
*Tablesaw Splitters and Blade Covers, Fine Woodworking*, pp. 77-81, Dec. 2001.
The Merlin Splitter by Excalibur a Sommerville Design Product Overview & Generic Installation Notes, Sommerville Design & Manufacturing Inc., at least as early as 2002.
Ryobi 10" Table Saw BT3100 Operator's Manual, Ryobi Technologies, Inc., Aug. 2002.
Rojek KPF 300A-xxxx-RN-1P3 Table Saw/Shaper Combination Machine specification sheet, Sep. 30, 2002.
Laguna Tools Signature Series by Knapp, Oct. 21, 2002.
Rojek Circular Saw PK 300 Spare part catalogue, Apr. 14, 2003.
Ridgid TS3650 Operators Manual 10" Cast Iron Table Saw, May 2003, Jun. 2003 and Jul. 15, 2003.
Porter-Cable Double Insulated 10" Bench Top Table Saw Instruction Manual, Porter-Cable Corporation, Sep. 15, 2003.
SI300S-S1300S4 Circular with Tilting Blade Spare Parts Catalogue, SCM, Oct. 30, 2003.
Delta Biesemeyer 10" Table Saw Blade Guard Systems Instruction Manual, Delta Machinery, May 9, 2005.
Powermatic WMH Tool Group Operating Instructions and Parts Manual 10-inch Cabinet Saw Model 2000, Nov. 2005.
Makita Model 2704 Exploded Drawings and Parts List, Nov. 2005.
Porter-Cable 10" Portable Table Saw 3812, Porter-Cable Corporation, 2005.
Porter Cable 10" Portable Table Saw Model 3812 Parts List with Guard Exploded View, 2005.
Grizzly Industrial, Inc. Model G0605X/G0606X Extreme Series 12" Table Saw Owner's Manual, Grizzly Industrial, Inc., Oct. 2006.
*Riving Knives—Not Just for The Europeans Anymore, Popular Woodworking*, Jul. 20, 2007.
WoodNet Forums Woodworking Talk Forum, posting dated Jan. 9, 2008.
Grizzly Industrial, Inc. Model G0651/G0652 10" Extreme Series Table Saws Owner's Manual, Grizzly Industrial, Inc., Mar. 2008.
SCM SI 450 Circular saw with tilting blade product brochure, Villa Verucchio, Italy, undated.
SCM Group publication, Rimini, Italy, undated.
Makita Table Saw 2704 Instruction Manual, Makita Corporation of America, date unknown.
Laguna Tools table saw owner's manual, date unknown.

* cited by examiner

BLADE GUARD FOR A TABLE SAW

CROSS-REFERENCE TO RELATED APPLICATION

This application claims the benefit of and priority from the following U.S. Provisional Patent Application, the disclosure of which is herein incorporated by reference: Ser. No. 61/463,557, filed Feb. 17, 2011.

TECHNICAL FIELD

The present disclosure relates to table saw attachments designed to improve safety and performance. More specifically, this disclosure relates to blade guards with hold-down capability, splitters, and anti-kickback devices.

BACKGROUND

A table saw is a power tool used to cut a workpiece to a desired size or shape. A table saw includes a work surface or table and a circular blade extending up through the table. A person uses a table saw by holding a piece of wood or other workpiece on the table and feeding it past the spinning blade to make a cut. Sometimes the workpiece will climb or rise up on the blade, creating a safety hazard that can result in the workpiece shifting unexpectedly or being kicked back or propelled by the blade toward the user. A user may inadvertently contact the spinning blade while trying to reposition the workpiece or as a result of the workpiece shifting or kicking back. The blade guard disclosed in this document provides a configuration that holds the workpiece down as the workpiece approaches the blade and as it is being cut to minimize the workpiece from climbing on the blade.

The disclosed blade guard also includes structure to substantially enclose the blade and protect against contact with the blade, a splitter or spreader to keep a workpiece from shifting sideways and catching on the rear edge of the blade, and an anti-kickback device such as a set of anti-kickback pawls configured to oppose a workpiece being thrown back toward a user. In one configuration, the blade guard also provides a block to prevent workpieces from contacting the blade if the workpieces are too high or thick to freely pass under the anti-kickback pawls or under any other structure associated with the blade guard and/or splitter.

BRIEF DESCRIPTIONS OF THE DRAWINGS

DETAILED DESCRIPTION

Figure 1:
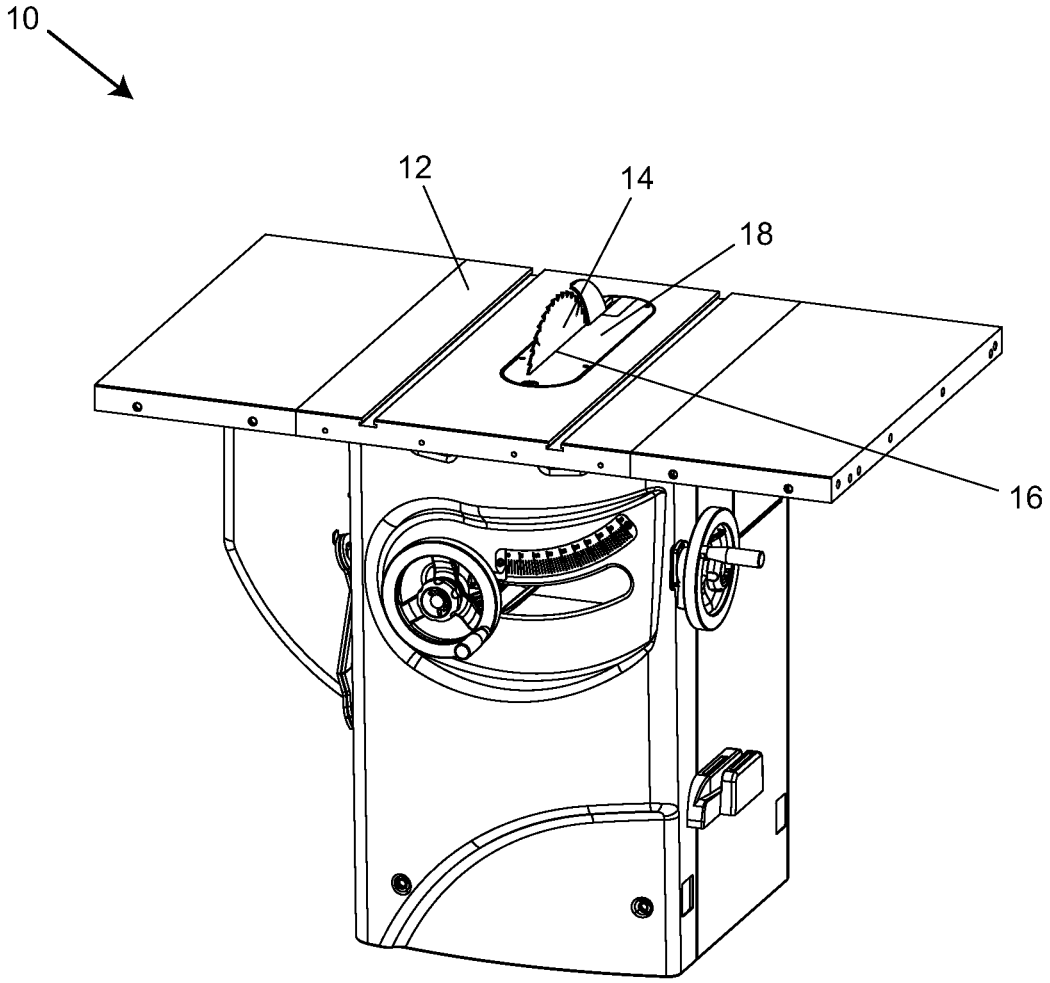
PRIOR ART Fig. 1
FIG. 1 shows a table saw.

FIG. 1 shows a saw 10 including a table 12 and a circular blade 14. The blade extends up through a slot 16 in a table insert 18, and the insert 18 fits within an opening in the table.

A piece of wood, or other material to be cut, is placed on the table and pushed into contact with the spinning blade to make a cut.

Figure 2:
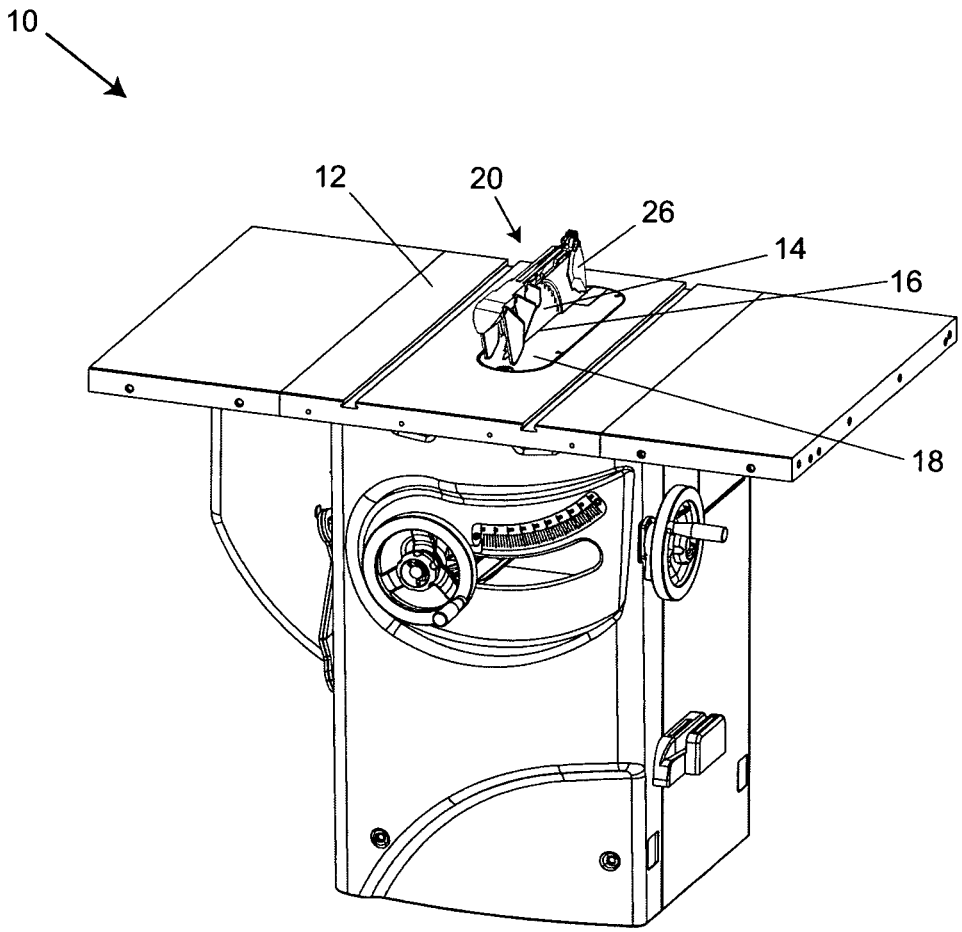
FIG. 2 shows the table saw of FIG. 1 equipped with a blade guard.

FIG. 2 shows the saw of FIG. 1 with a blade guard 20. The main purpose of blade guard 20 is to protect a user of the saw from accidentally contacting the spinning blade. The blade guard is shown in more detail in FIGS. 3-10. The blade guard includes a top guard 22 and side guards 24. The top guard prevents a user from moving down into the teeth of the blade from a position above the saw, and the side guards 24, which include front side guards 28, 34, middle side guards 30, 36, and rear side guards 32, 38, stop a user from moving into the teeth of the blade from the side. The blade guard is mounted on a splitter 26. The splitter is positioned behind and adjacent the back edge of the blade, thereby preventing a workpiece from shifting and catching the back edge of the blade which could result in kickback. The splitter also shields the back edge of the blade and helps prevent a user from accidentally contacting the back edge of the blade.

Figure 3:
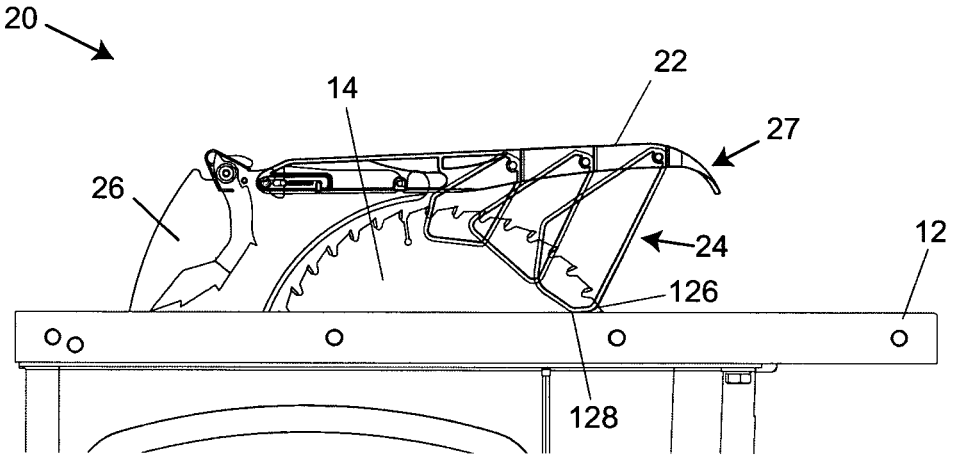
FIG. 3 shows a side view of the blade guard of FIG. 2 installed in the table saw of FIG. 1 with the blade elevated.

In the exemplary embodiment shown in FIGS. 3-10, top guard 22 is made from an elongate and rigid piece of transparent polycarbonate. The top guard attaches to the splitter and extends toward the front of the saw, as shown in FIG. 3. The top guard extends far enough to cover the top edge of the blade and to prevent a user from contacting the blade from above. The transparency of the top guard allows the user to see the blade and the workpiece as the workpiece is being cut.

The forward end of the top guard includes a nose or tip 27 that slopes down toward table 12. When the top guard is mounted on the splitter in the configuration shown in FIG. 3, the tip is the lowest part of the top guard, or the part of the top guard closest to table 12, and it extends below the top guard's lower surface. Tip 27 blocks a workpiece from moving into the blade if the workpiece is too thick to move past the splitter or past any devices attached to the splitter. Expressed differently, the height or thickness of a workpiece that can be successfully cut with the blade guard installed on the saw is limited by the presence of the top guard and other structures attached along the top of the splitter that would interfere with an over-thick workpiece. Accordingly, tip 27 functions to prevent over-thick workpieces from moving into the blade and possibly jamming against or bumping into the splitter or other structures, which could result in a dangerous condition for the user.

In the exemplary embodiment shown in FIGS. 3 through 10, top guard 22 is also relatively narrow from side-to-side. Making the top guard narrow allows a user to position a workpiece guide or fence as close as possible to the blade to make narrow cuts. Top guard 22 is most narrow at the back end (i.e., the end that attaches to the splitter) and the top guard gets wider moving towards the front to accommodate any sideways deflection.

FIGS. 11 through 16 show top guard 22 isolated from other structure. The top guard has a top surface 44 which runs from the tip 46 of the nose 27 to about the middle of the top guard, where it separates into two strips 47 with a gap 150 between the strips. Gap 150 allows the top guard to fit over the splitter and be mounted thereto, as will be explained.

To form nose 27, the front of the top surface curves down and tapers inward along the sides. The taper on the left side allows the blade guard to tilt to forty-five degrees without interfering with the table and the taper is mirrored on the right side to be aesthetically pleasing. The sides taper moving down as if coming to a point but instead of forming a point the sides are clipped off near the bottom so that the tip 46 of the nose is flat or cut straight across. Side walls 50 of the top guard meet the edges of the top surface as it curves down to give support to the nose and follow the curved surface gradually tapering off a little over half way down the nose. The nose extends down about one-and-one-half inches from the top of the top guard, ending anywhere from zero to about three-eighths of an inch above the top of the blade when the guard is installed on the splitter. As stated, the nose acts like a stop to prevent workpieces that are too thick from moving in toward the blade and splitter.

Figure 4:
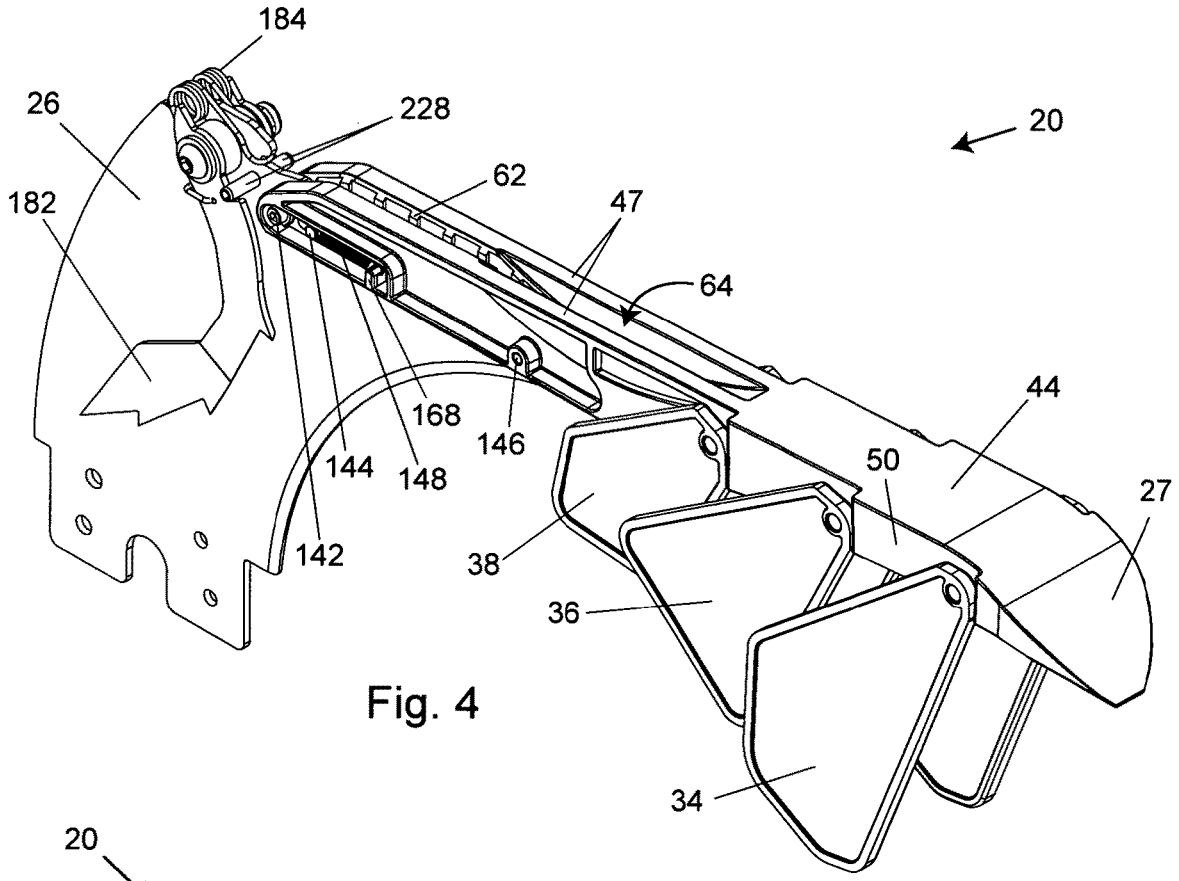
FIG. 4 shows a perspective view of the blade guard in FIG. 2.
Figure 15:
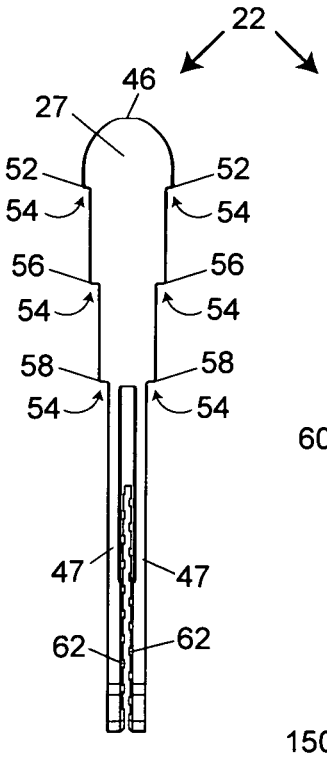
FIG. 15 shows a top view of the top guard of the blade guard in FIG. 2.

Side walls 50 extend down from the top surface as shown and have three steps or indentations moving from the nose towards the rear. These indentations allow the side guards to run alongside the side walls and overlap each other, as shown in FIG. 4. The first indentation 52 is at the front of the top guard just behind the nose, as shown in FIG. 15. The side walls are inset a distance roughly equal to the thickness of the front side guards leaving a flat vertical surface 54 facing the rear and positioned just in front of each front side guard. Moving to the rear about two inches from the first vertical surface is a second vertical surface 54 formed by a second indentation 56 which provides a place for the middle side guard to fit between the inner side of the front side guard and the side wall of the top guard. Moving again to the rear about two inches from the second vertical surface is a third vertical surface 54 formed by a third indentation 58 which provides a place for the rear side guard to fit between the inner side of the middle side guard and the side wall of the top guard. At this point the side walls have reached the narrowest width, which is then maintained all the way to the end of the top guard moving to the rear. Another two inches back from the third vertical surface is a vertical wall 60 that runs between the two side walls for strength. Beyond this vertical wall 60 the two side walls of the top guard are separated by gap 150. The inner surface of each side wall adjacent gap 150 includes projections 62 in the form of a set of vertical ridges 62, spaced about one-half inch apart. These ridges contact the sides of the splitter to keep the top guard positioned correctly.

Figure 17:
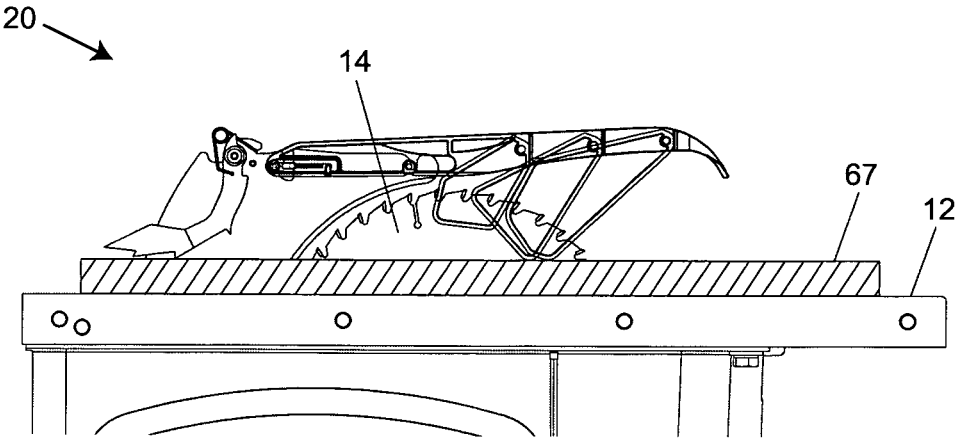
FIG. 17 shows a side view of the blade guard of FIG. 2 installed in the table saw of FIG. 1 with a piece of wood being cut.

Side guards 24 hang down from top guard 22, as shown in FIG. 3, and are free to pivot around their points of connection to the top guard. Because they are free to pivot, the side guards rotate back when contacted by a workpiece moving toward the blade and they rest upon the top surface of the workpiece as the workpiece moves past, as shown in FIG. 17. When the workpiece moves past the side guards, the side guards drop back down due to gravity. This configuration may be referred to as floating or free-floating side guards.

The side guards hang down from both the right and left sides of the top guard to shield each side of the blade. In the depicted embodiment, there are three side guards on each side, although there could be more. The side guards on the right side include front side guard 28, middle side guard 30 and rear side guard 32. The side guards on the left side are mirror images of those on the right side, and they include front side guard 34, middle side guard 36 and rear side guard 38. Each side guard is generally flat with a rim around the edge and has a somewhat triangular shape. In order to shield the teeth of the blade, the front side guards are larger than the middle side guards which are in turn larger than the rear side guards. The side guards are pivotally attached to the top guard by press-fit rivets 68 and, as stated, are free to pivot. The side guards are positioned so that they overlap slightly when they hang down. They are also positioned so that they do not catch on one another when they pivot. The rear side guard is seated farthest inward, next is the middle side guard, and finally, the front side guard which is seated farthest to the outside, as can be seen in FIG. 4. The side guards cover the teeth of the blade from the top of the blade to the front. They are sized to cover about a 1-inch thick strip along the outer perimeter of the blade. In the depicted embodiment, the side guards do not cover the rear of the blade; the splitter covers the teeth at the rear of the blade.

Figure 18:
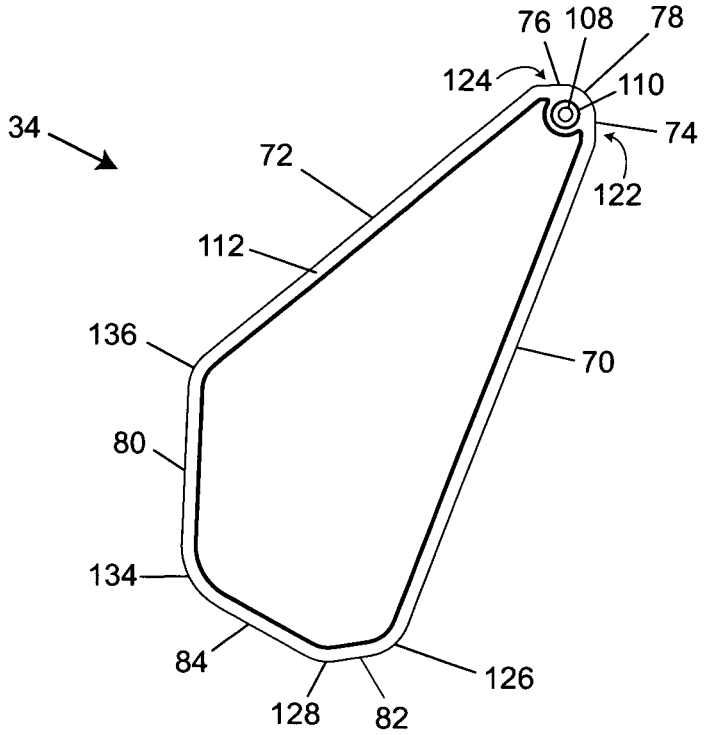
FIG. 18 shows a side view of the left front side guard of the blade guard in FIG. 2.
Figure 19:
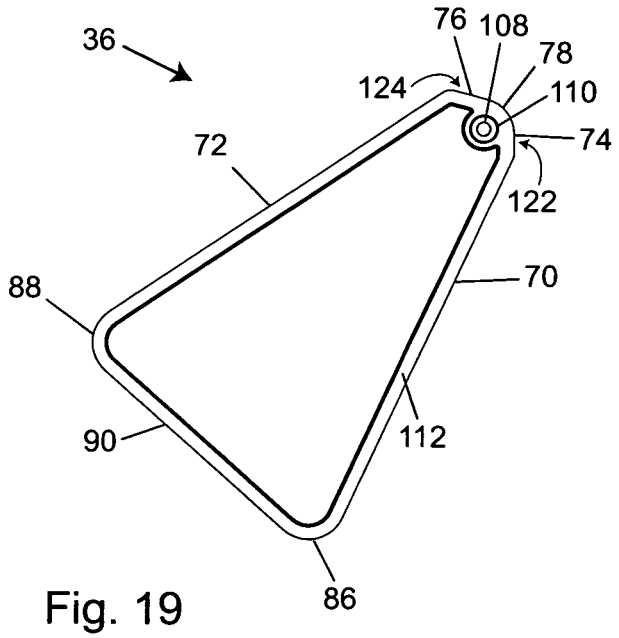
FIG. 19 shows a side view of the left middle side guard of the blade guard in FIG. 2.
Figure 20:
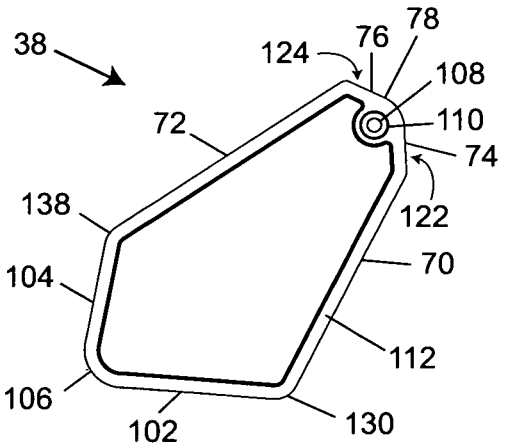
FIG. 20 shows a side view of the left rear side guard of the blade guard in FIG. 2.

The side guards are generally triangularly shaped, as mentioned, with the smallest angle, roughly thirty degrees, formed at the top between two long straight sides—side 70 which faces the front of the side guard, and side 72 which faces the rear of the side guard, as shown in FIGS. 18 through 20. The two sides approach each other, without intersecting, near the top of the side guard close to the rivet. Each of the two long straight sides is joined to short straight segments 74 and 76, one segment at the end of each long straight side at the end closest to the rivet. The short straight segments are joined by a short curved segment 78 which forms a rounded corner about the rivet. The two straight segments 74 and 76 are oriented such that lines perpendicular to each segment form an angle that ranges from roughly ninety degrees for the front side guard to sixty degrees for the rear side guard.

The bottom portions of the side guards are different for the front, middle and rear side guards in order to provide the desired blade coverage. The front side guard is like a triangle with each bottom corner clipped off, and with the corner that faces the rear clipped off more than the other bottom corner. The clipped corners are replaced by straight segments 80 and 82, and a straight bottom segment 84 runs between them, as shown in FIG. 18. In all, the perimeter of the front side guard consists of long straight side 70 joined to a short straight segment 74 joined to a rounded corner 78 about the rivet, joined to another short straight segment 76 joined to another long straight side 72 joined to a shorter straight segment 80 which is joined to a slightly shorter straight bottom segment 84 that is joined to an even shorter straight segment 82 which joins the bottom end of the long straight side 70 to complete the perimeter.

The middle side guard 36, shown in FIG. 19, is shaped like a triangle with two bottom rounded corners 86 and 88 on either side of a straight bottom segment 90, and two long straight sides 70 and 72 which join short segments 74 and 76 and rounded corner 78 at the top. The length of bottom segment 90 of the middle side guard is about the same as length of the long straight side 72 of the front guard. The lengths of the long straight sides of the middle side guard are approximately the same and these are about the same as the length of the long straight sides of the front side guard.

The rear side guard 38, shown in FIG. 20, is shaped like a triangle with both bottom corners clipped off and replaced by segments 102 and 104 which join at a rounded corner 106. Segment 102 is forward of segment 104 and slightly longer than segment 104. Segment 104 joins with side 72 at rounded corner 138. Side 102 is joined to side 70 at corner 130. Segments 74 and 76, and rounded corner 78, join sides 70 and 72, as with the other side guards. Of course, the side guards could take many other shapes.

As mentioned, the side guards are pivotally attached to the top guard by press-fit rivets 68. Each rivet is pressed into a hole 108 in a boss 110 on the outside of each side guard near the top of each side guard under rounded corner 78 (the holes and bosses are labeled in FIGS. 18 through 20). The rivets are press-fit into the holes in the side guards so that they rotate along with the side guards to reduce play in the assembly. Each boss 110 is flush with a raised rim 112 around the perimeter of each side guard. The raised rim minimizes the contact area between the side guards to reduce friction between the side guards as they pass by each other when pivoting. Each rivet then passes through a hole 114 in a raised boss 116 along side wall 50 of top guard 22. Bosses 116 are raised to create a little gap between the side guards and the side wall. An E-clip 118 (shown in FIG. 10) fits around a groove at the end of each rivet to secure each rivet in place. The top guard is designed to be as narrow as possible and the E-clips provide a way to secure the rivets with minimal extension towards the interior of the guard.

Surfaces 122 on the outer edge of segments 74 of each side guard face the front of the top guard and act, in conjunction with vertical surfaces 54 on the top guard, as stops. When the side guards hang down without contacting a workpiece or the saw table, surfaces 122 contact vertical surfaces 54 and keep the side guards in a position where sides 70 slope back, as shown in FIG. 3, so that when the blade guard is installed in the saw, the side guards will pivot back as the blade is lowered or when a workpiece is fed into the blade guard.

In order for the side guards to pivot back smoothly and reliably, the side guards are designed so that the point of contact between the bottom of each side guard and the surface of the table is positioned to the rear of the rivet attaching the side guard to the top guard. The farther back the contact point is from the pivot point the more easily the side guard pivots back. However, if the front edge of the front side guards (i.e., sides 70) in the depicted embodiment were to run from near the rivet to the point of contact with the table, in some positions the front side guard would not adequately cover the teeth of the blade from the sides. Accordingly, front side 70 of the front side guards runs from near the rivet down to a first corner point 126 that is forward of a second corner point 128 between segments 82 and 84, as shown in FIG. 3. When in the position shown in FIG. 3, second corner point 128 is the point of contact with the table. As the front side guards pivot back, second corner point 128 rises up and first corner point 126 becomes the point of contact with the table or workpiece. For the middle side guards, the bottom corner 86 contacts the table or workpiece. The front side guards continue to contact the table at contact point 126 as the middle side guards pivot back so that the front teeth of the blade continue to be adequately covered, as shown in FIG. 17. For the rear side guards, bottom corner 130, between side 70 and segment 102, contacts the table or workpiece. As with the front and middle side guards, corner 130 on the rear guard is positioned far enough back from the rivet to allow the rear side guard to pivot back smoothly while providing coverage for the teeth of the blade. Side 102 at the bottom of the rear side guard extends to the rear to further cover the blade.

Figure 21:
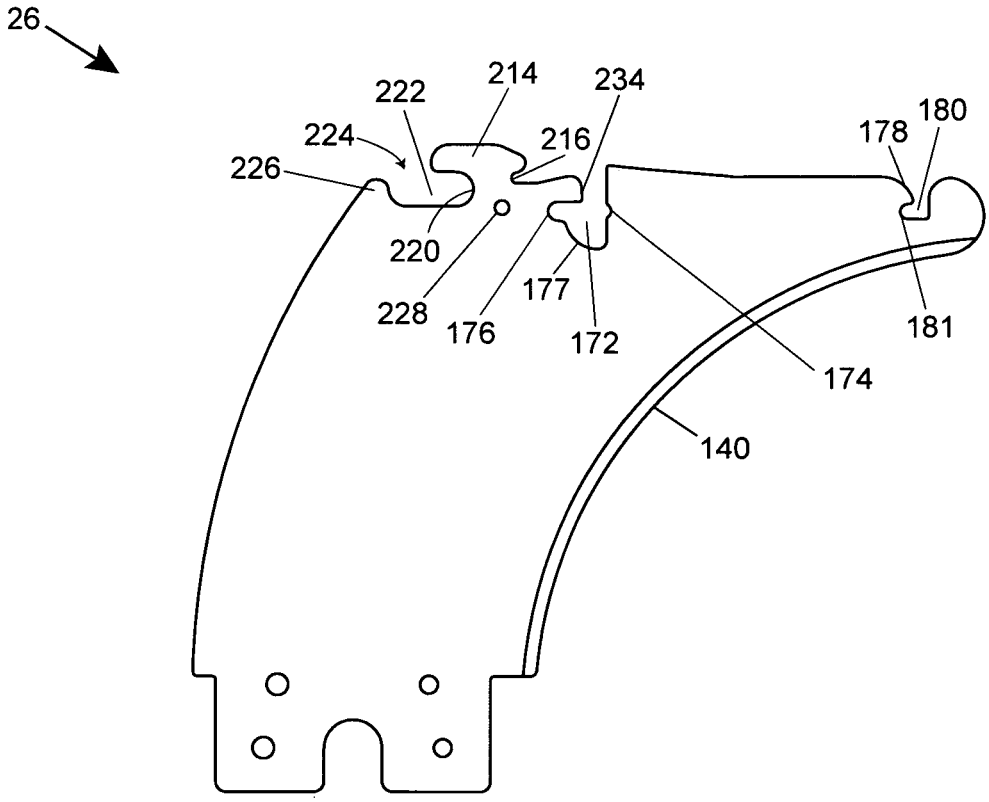
FIG. 21 shows a side view of the splitter of the blade guard in FIG. 2.

Top Guard 22 is mounted on splitter 26, as shown in FIG. 3. The splitter is a flat piece of metal with a front edge 140 shaped to follow the perimeter of the blade, as shown in FIG. 21. The splitter is securely mounted in the saw to move with the blade as the blade changes elevation and/or tilts. As stated previously, the splitter functions to prevent the workpiece from shifting and to shield the back of the blade.

Top guard 22 attaches to splitter 26 in such a way that it is held securely in place when in its operable position, but is also quickly and easily installed or removed by hand without the need of tools and without the need of moving a bail or lever. A user might remove the top guard for some cutting operations, and therefore, being able to install and remove the top guard quickly and easily facilitates guard usage and makes it more likely that a user will re-install the top guard after removing it.

Figure 22:
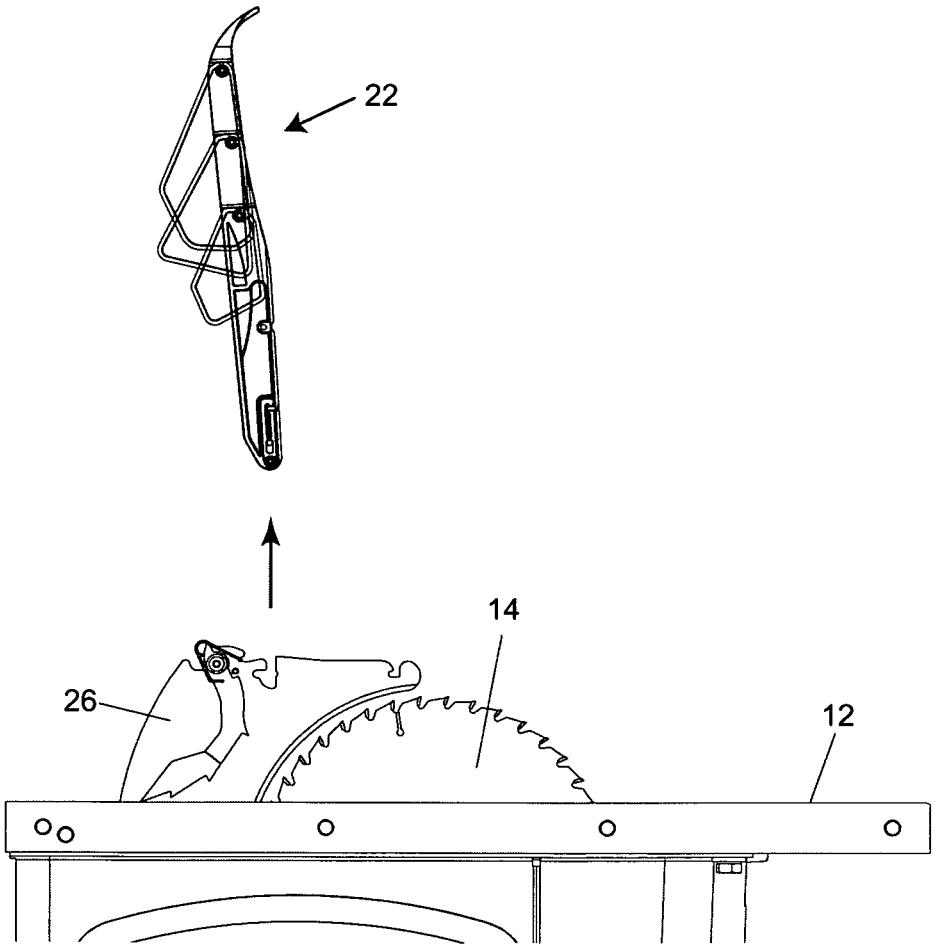
FIG. 22 shows a side view of the splitter of the blade guard of FIG. 2 installed in the table saw of FIG. 1 with the top guard lifted out of the splitter.

In the depicted embodiment, a user removes the top guard from the splitter by first pulling the top guard forward or toward the front of the saw, and then rotating the top guard upward to a substantially vertical position. Once the top guard is in a substantially vertical position it can be lifted up and away from the splitter, as shown in FIG. 22. These steps are repeated in reverse to install the top guard; the top guard is first oriented substantially vertically then set into the splitter and rotated downwards until it snaps into place.

Figure 10:
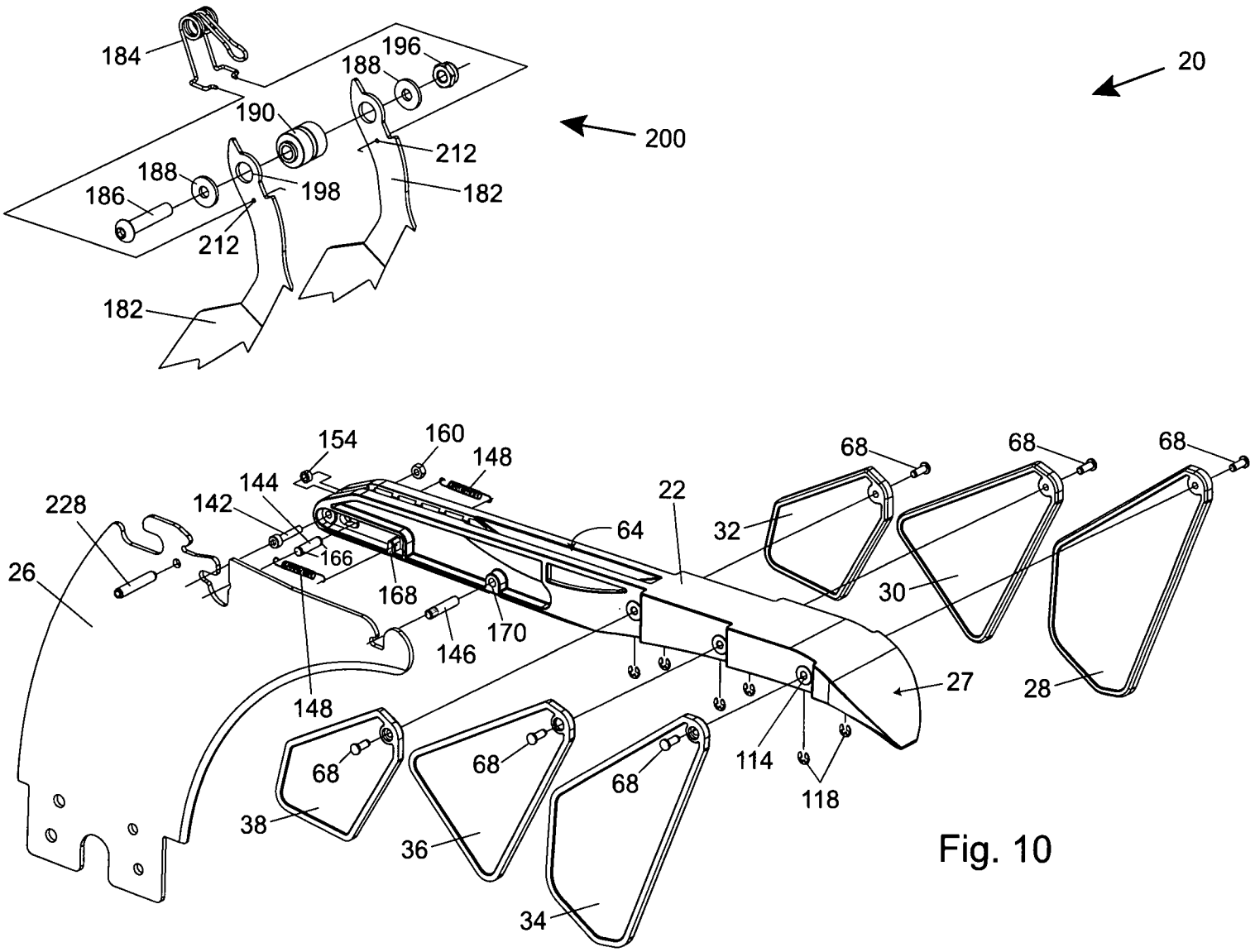
FIG. 10 shows an exploded view of the blade guard in FIG. 2.
Figure 11:
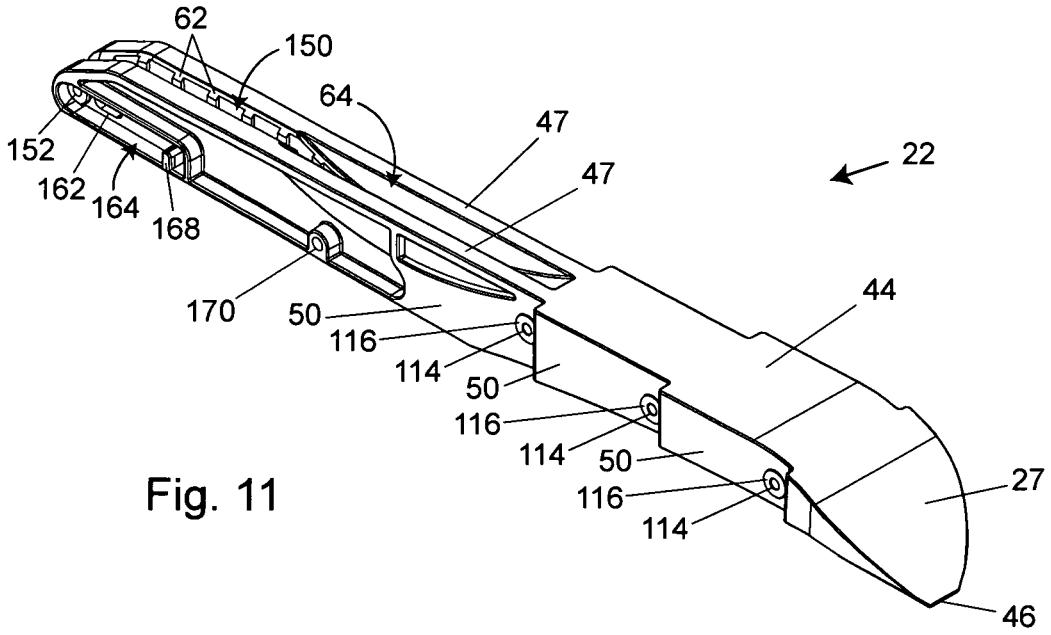
FIG. 11 shows a perspective view of the top guard of the blade guard in FIG. 2.
Figure 12:
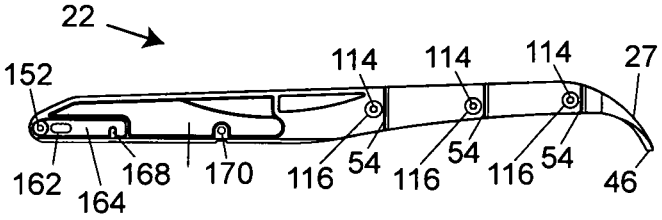
FIG. 12 shows a left side view of the top guard of the blade guard in FIG. 2.
Figure 13:
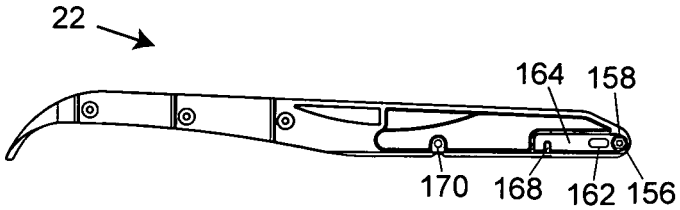
FIG. 13 shows a right side view of the top guard of the blade guard in FIG. 2.
Figure 14:
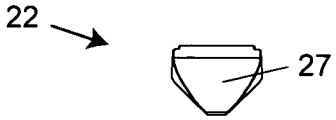
FIG. 14 shows a front view of the top guard of the blade guard in FIG. 2.
Figure 16:
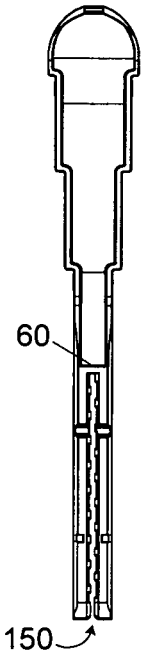
FIG. 16 shows a bottom view of the top guard of the blade guard in FIG. 2.

A latch mechanism by which the top guard is held on the splitter consists of a bolt 142, two pins 144 and 146, and two coil springs 148, one spring on each side of the top guard. Bolt 142 is located toward the rear and along the bottom of the top guard, as shown in FIG. 10. As mentioned, the right and left sides of the top guard are set apart with a gap 150 between them, as shown in FIG. 16. The top guard is configured to fit over the splitter with the splitter filling gap 150. To keep the top guard rigid, bolt 142 passes through a hole 152 in the left side of the top guard and then through a spacer 154 situated between the left and right sides of the top guard and then through a hole 156 in the right side of the top guard. A hexagonal cavity 158 on the outside wall of the right side of the top guard holds a nut 160 that is threaded on the end of bolt 142. Pin 144 passes through two aligned oval holes 162, one hole in each side of the top guard. Pin 144 is free to move in the oval holes and is held in place by the two springs 148. The springs lie lengthwise within recessed areas 164 on the right and left sides of the top guard. One end of each spring fits within a groove 166 on each end of pin 144. The other end of each spring attaches to the top guard by hooking into a small hole located in a support 168 positioned within and towards the front of each recessed area 164. The springs are sized to bias or pull pin 144 toward the forward end of oval holes 162, but the pin can move to the rear of the oval holes by stretching the springs. Second pin 146 is press-fit into a hole 170 on the side of the top guard forward from pin 144. The top guard attaches to the splitter at pins 144 and 146 and so those pins are spaced apart far enough to create a sturdy structure that has minimal lateral movement.

To install the top guard on the splitter, the top guard is first oriented substantially vertically with spacer 154 positioned above a cutout 172 in the splitter. Cutout 172 is shaped somewhat like the letter "J", as shown in FIG. 21. Cutout 172 includes a first notch 174 in the forward edge of the cutout, and a second notch 176 in the rear section of the cutout. The top guard is lowered into cutout 172 until the spacer 154 and pin 144 hit the bottom of the cutout, and the top guard is then tilted forward. As the top guard tilts forward, spacer 154 rides up a curved section 177 along the bottom of the cutout and the spacer moves into second notch 176. At this point, spacer 154 and pin 144 are trapped in notch 176 and cannot move further up. As the top guard moves further down, it pivots about spacer 154 and eventually pin 146 hits a curved edge 178 at the entry of another cutout 180 located towards the front of the splitter. Curved edge 178 guides pin 146 into cutout 180 while stretching springs 148. Cutout 180 includes a notch 181 shaped so that when pin 146 moves past curved edge 178, springs 148 pull pin 146 toward the back of the splitter and into notch 181, thereby holding pin 146 in place. At the same time, springs 148 pull pin 144 into notch 174 in cutout 172. The tension in springs 148 keeps pins 144 and 146 pulled tightly together against the splitter thus securing the top guard in place on the splitter.

Positioning cutouts 172 and 180 a relatively large distance apart, having splitter 26 extend into gap 150 in the top guard, and sizing gap 150 so that projections 62 contact the sides of the splitter, allows the top guard to be attached or mounted securely to the splitter without any significant side-to-side play in the top guard. Also with this configuration, a user can release or remove the top guard from the splitter by pulling the top guard forward to stretch springs 148 until pin 146 clears notch 181. The user can then pivot the top guard upward until pin 144 clears notch 174, and then the user can lift the top guard up and away from the splitter, as described. This can all be done without using any tool and without having to move a locking bail or lever.

Figure 36:
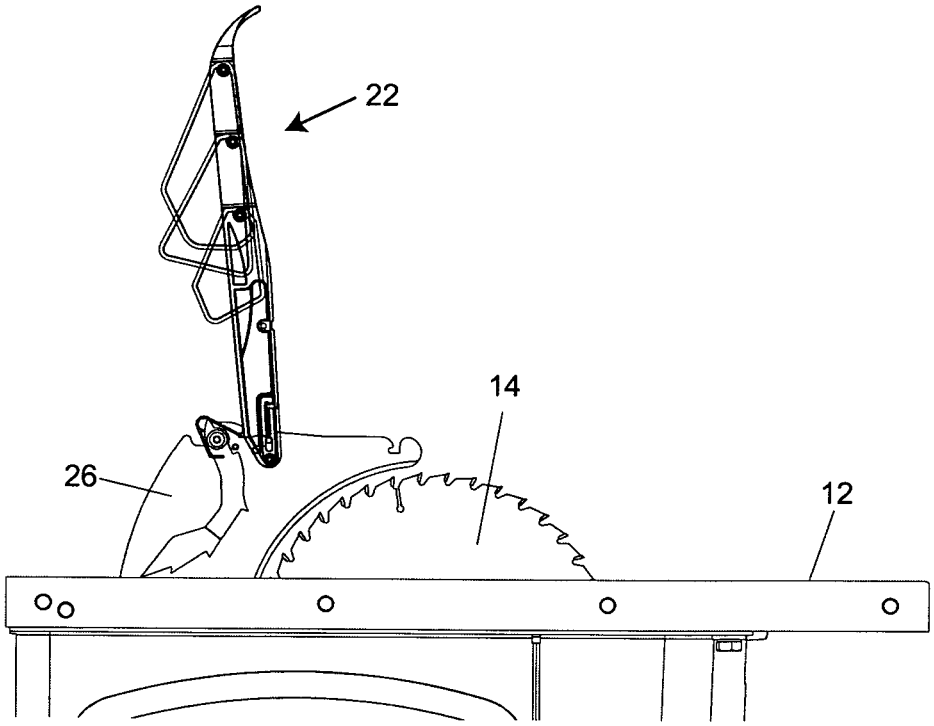
FIG. 36 shows a side view of the blade guard of FIG. 2 raised.

Additionally, the user can pivot the top guard up to a generally vertical position while pin 166 remains in cutout 172, as shown in FIG. 36. Cutout 172 in the splitter includes a surface 234, shown in FIG. 21, which provides a stop against which the top guard can rest when the top guard is pivoted up. With the top guard in this position, a user can perform tasks, such as changing the blade, without having to completely remove the top guard from the splitter.

The configuration of the top guard described thus far allows a workpiece to pass under the top guard with only the bottom edges of the side guards contacting the workpiece. With this configuration the top guard is above the blade and there is a gap between the top of the blade and the bottom of the top guard. This configuration provides the maximum possible depth of cut while using the top guard. However, with this configuration a workpiece may also shift or climb the blade unexpectedly, which can result in a dangerous condition such as kickback. To address this issue, top guard 22 can be flipped over to hold down the workpiece.

Figure 23:
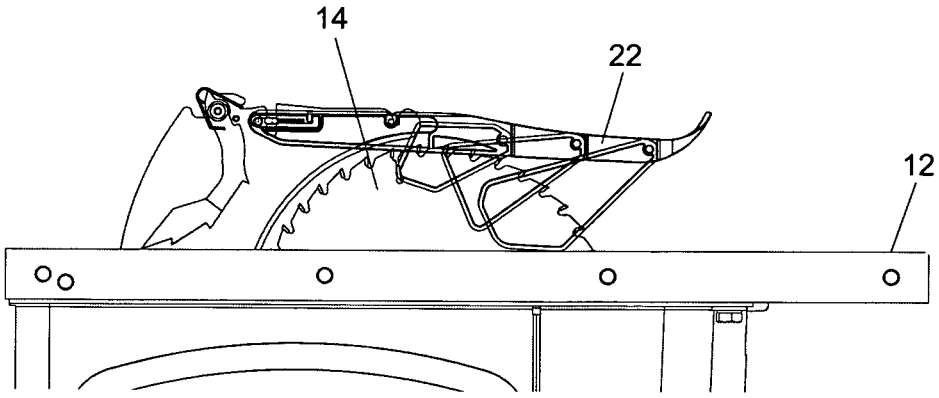
FIG. 23 shows a side view of the blade guard of FIG. 2 installed in the table saw of FIG. 1 in a hold-down position with the blade elevated.
Figure 24:
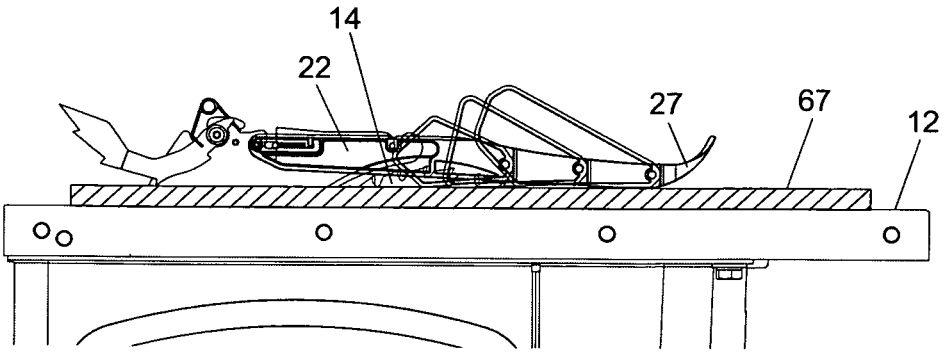
FIG. 24 shows a side view of the blade guard of FIG. 2 installed in the table saw of FIG. 1 in a hold-down position and a piece of wood being cut.

FIG. 23 shows top guard 22 mounted on splitter 26 in a hold-down position. In this position the front of the top guard is closer to the table than the rest of the top guard, and also closer to the table than any other items attached to the splitter, such as anti-kickback pawls. In the depicted embodiment, this is accomplished by the top guard slanting down at a slight angle from the splitter towards the front of the saw. When in a hold-down position, the top of the blade protrudes up into the top guard so that the bottom of the top guard is slightly below the top of the blade. For example, the bottom of the top guard may be around ¼ inch below the top of the blade. With the top guard in this configuration, a user can adjust the elevation of the blade and top guard so that the top guard contacts the top surface of the workpiece as the workpiece is moved into the blade, thereby holding the workpiece down against the table, while the top of the blade still extends above the workpiece to cut through the workpiece, as shown in FIG. 24. The top guard can be constructed to have some limited or inherent flexibility so that when the top guard is lowered onto the workpiece, a downward force is created on the workpiece by the top guard in the area of contact to help hold the workpiece on the table.

In the hold-down position a workpiece can be guided into the blade with more control since the top guard helps hold the workpiece down. This is particularly helpful when cutting sheet goods such as 4'×8' plywood sheets which can flex and climb the blade, and which can be difficult for a person to handle and feed into the saw without shifting.

The top guard includes a hollow area 64, shown in FIG. 4 on what is the upper surface of the top guard in that figure. However, when the top guard is in the hold-down position shown in FIGS. 23 and 24, hollow area 64 is on the underside of the top guard and the hollow area fits over and around the top of the blade. The hollow area is shaped to follow the contour of the blade so that the blade can extend up into the interior of the top guard.

When the top guard is turned over for the hold-down configuration, side guards 24 pivot around so that they continue to hang down from the top guard and shield the teeth of the blade. The side guards function as in the non-hold-down configuration discussed above, although side edges 72 face forward instead of sides 70. Additionally, surfaces 124 on the side guards abut surfaces 54 on the top guard to hold the side guards at an angle, instead of surfaces 122. As stated, in the depicted embodiment the top guard is designed to slope down when in the hold-down position so that the lowest point on the top guard is at the bottom of the nose, thus reducing the chance of binding occurring between the workpiece and the top guard as the workpiece moves past the blade. The shapes of the side guards are determined experimentally to achieve the desired blade coverage whether the guard is in a hold-down or non-hold-down position. The guard may quickly and easily be removed or installed from a hold-down position in the same way as it can be removed or installed from the non-hold-down position described earlier. The ability of the blade guard described herein to be quickly and easily changed from a non-hold-down position to a hold-down position without the use of tools and without having to move a bail or lever is a significant advantage over other blade guards.

Blade guard 20 also includes a pair of anti-kickback pawls 182, as shown in FIGS. 4 through 10. The anti-kickback pawls are designed to rotate back and ride gently on the surface of a workpiece as the workpiece moves past the blade without impeding the movement of the workpiece. However, if the workpiece kicks back toward the user, the anti-kickback pawls dig into the workpiece to stop the kickback.

Sometimes a workpiece may be soft or have a surface prone to scratching, or the anti-kickback pawls may be biased down with enough force to scratch or leave visible impressions on the surface of the workpiece. If the anti-kickback pawls cannot be easily removed or disabled, the user might remove the entire blade guard or permanently remove the anti-kickback pawls to avoid scratching the workpieces. To address this situation, anti-kickback pawls 182 are designed in such a way that they can either be rotated up into a position that holds them out of the way or they can be easily removed and re-installed without the use of tools.

Figure 8:
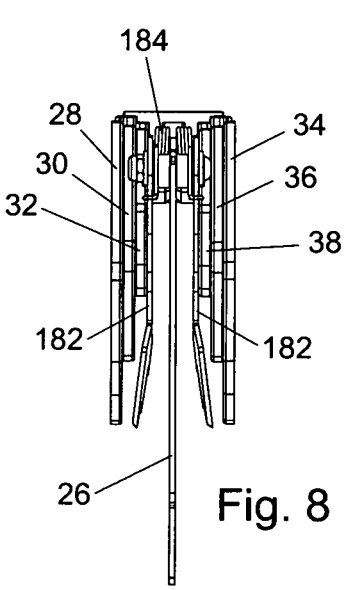
FIG. 8 shows a rear view of the blade guard in FIG. 2.
Figure 9:
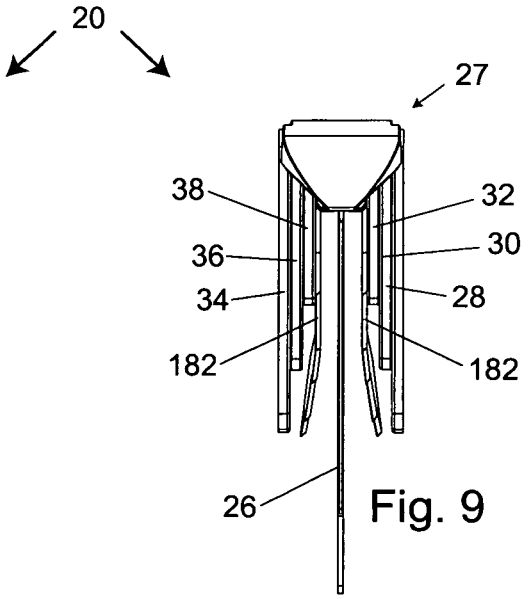
FIG. 9 shows a front view the blade guard in FIG. 2.
Figure 25:
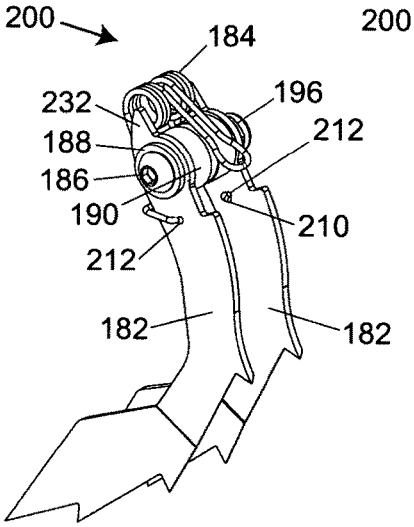
FIG. 25 shows a perspective view of the pawl assembly of the blade guard in FIG. 2.
Figure 26:
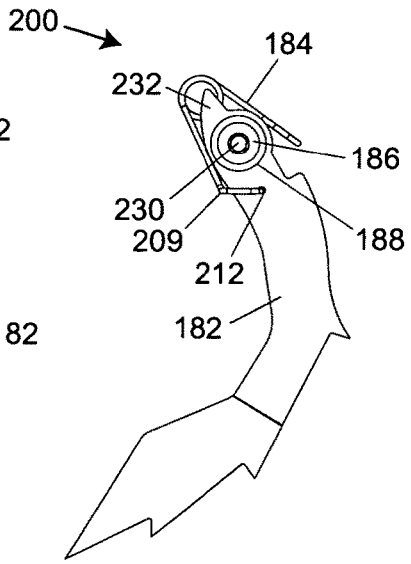
FIG. 26 shows a side view of the pawl assembly of the blade guard in FIG. 2.
Figure 27:
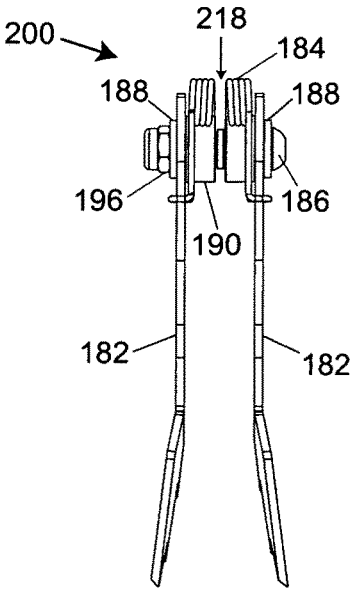
FIG. 27 shows a rear view of the pawl assembly of the blade guard in FIG. 2.
Figure 28:
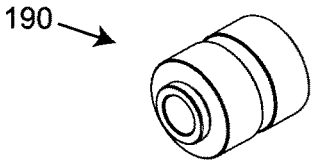
FIG. 28 shows a perspective view of the bushing of the pawl assembly in FIG. 25.
Figure 29:
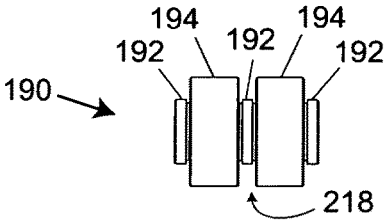
FIG. 29 shows a front view of the bushing of the pawl assembly in FIG. 25.

FIG. 10 shows an exploded view of anti-kickback pawl assembly 200, and FIGS. 25 though 27 show anti-kickback pawl assembly 200 isolated from other structure. Anti-kickback pawls 182 are held together in the anti-kickback pawl assembly by a spring 184 and bolt 186. Bolt 186 passes through a flat washer 188 then through a specially designed bushing 190 which also serves as a standoff. As shown in FIGS. 28 and 29, bushing 190 is cylindrical with three thin sections 192 of an equal smaller diameter and two wider sections 194 of an equal larger diameter. The sections are arranged so that one thin section with a smaller diameter is between the two wider sections with a larger diameter, and one thin section with a smaller diameter is on the outside of each wider section. On the other side of the bushing, bolt 186 passes through another flat washer 188 and then threads into a nut 196. The two, thin outside sections of bushing 190 have a diameter that is slightly smaller than the diameter of a hole 198 in each anti-kickback pawl near the top of the pawl (the hole is labeled in FIG. 10), and a width that is slightly larger than the thickness of an anti-kickback pawl. As shown in FIGS. 8 and 10, each anti-kickback pawl sits on one of the outside thin sections of bushing 190. The middle thin section of bushing 190 provides a groove for the splitter to fit into when the anti-kickback pawl assembly 200 is installed on the splitter.

Figure 30:
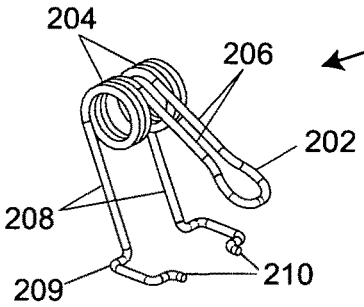
FIG. 30 shows a perspective view of the pawl spring of the pawl assembly in FIG. 25.
Figure 31:
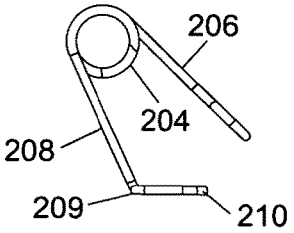
FIG. 31 shows a side view of the pawl spring of the pawl assembly in FIG. 25.
Figure 32:
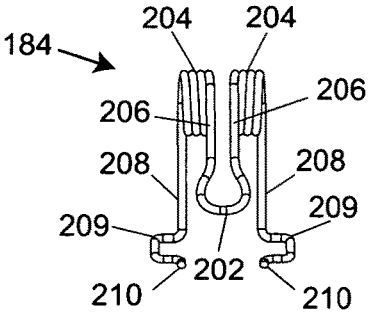
FIG. 32 shows a front view of the pawl spring of the pawl assembly in FIG. 25.

FIGS. 30 through 32 show various views of a spring 184. As shown in FIG. 31, spring 184 has a generally triangular shape when viewed from the side with a coil at the top corner and straight segments emerging downward from the front and the back sides of the coil. FIG. 30 shows a perspective view of spring 184. Spring 184 is formed out of a wire that is bent in the middle as if bent around the shaft of a small cylindrical rod to form an open loop 202. The two ends of the wire then approach each other so that the loop has an almost tear-drop shape after which the wires bend outward from each other slightly. The wires continue straight and more or less parallel to each other for about an inch leaving a gap between them which is a little wider than the thickness of the splitter. Each wire is then wound in such a way as to create a coil 204 on each side of the loop and the two coils are generally coaxial. Viewing the spring from the right side, the right coil is wound clockwise moving outward. Viewing the spring from the left side, the left coil is wound counter-clockwise moving outward. Each end of the wire exits its respective coil on the outward facing side of the coil, to the rear of the coil on the opposite side of the coil from which the loop extends. The ends of the wires continue straight and generally coplanar for about an inch. The plane formed by the straight wire segments 206 near the loop is at an angle, roughly thirty degrees, to the plane formed by the straight segments 208 that exit the coils. Each of the wires then bends roughly ninety degrees outward and continues about an eighth of an inch along a line that is roughly parallel to the axis through the coils. The wires then bend ninety degrees again forming a corner 209 and continue for about one quarter of an inch in a direction that forms an angle roughly 120 degrees with straight segments 208. Each wire then bends ninety degrees inward for another eighth of an inch parallel to the other eighth-inch segment. Finally, each wire bends ninety degrees and continues for about one-sixteenth of an inch in a direction roughly parallel to the quarter inch segments to from one-sixteenth of an inch spring end segments 210. A small hole 212 is located in each anti-kickback pawl, to the front of and below hole 198, and each spring end segment 210 passes through a hole 212 and lies roughly against the inner surface of each pawl to connect the spring to each pawl.

Spring 184 stretches over bushing 190 so that straight segments 206 lie against the front of the wider sections 194 of bushing 190 and straight segments 208 lie against the back side of sections 194. Corners 209 catch the back sides of each anti-kickback pawl and, as stated, each end 210 is inserted into a hole 212 in each anti-kickback pawl. Each hole 212 is positioned on an anti-kickback pawl so that the triangle formed by hole 212 and the point of contact between straight segment 206 and bushing 190 and the point of contact between straight segment 208 and bushing 190 keeps spring 184 in tension stretched over bushing 190 and holds the anti-kickback pawl assembly together as a unit.

Figure 5:
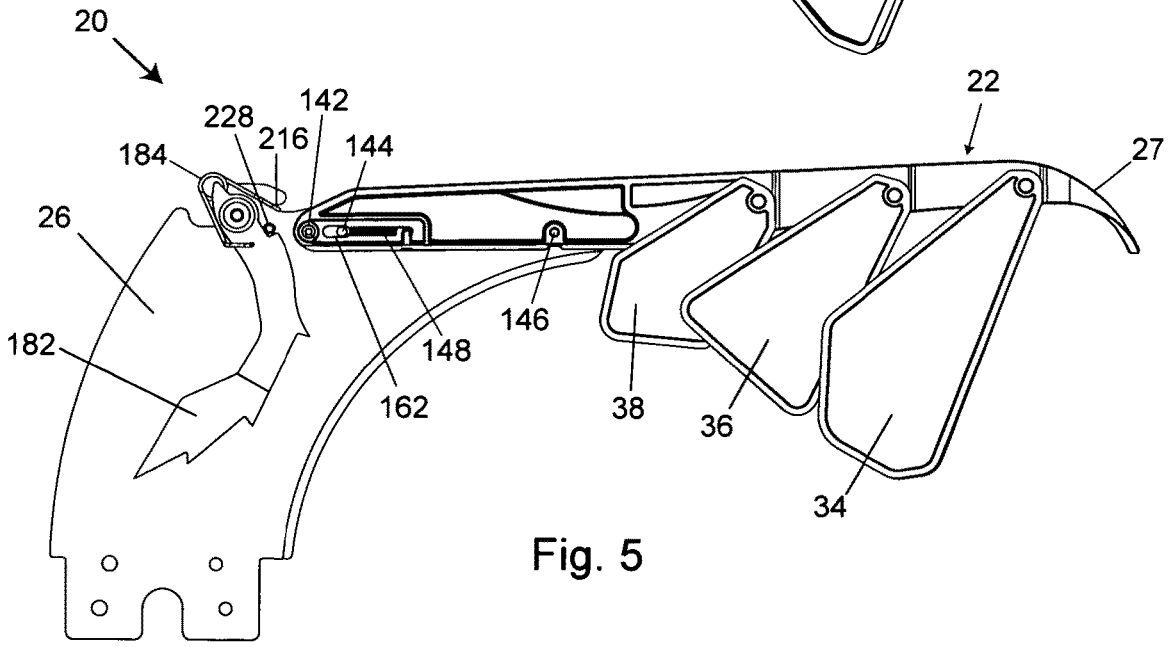
FIG. 5 shows a left side view of the blade guard in FIG. 2.
Figure 6:
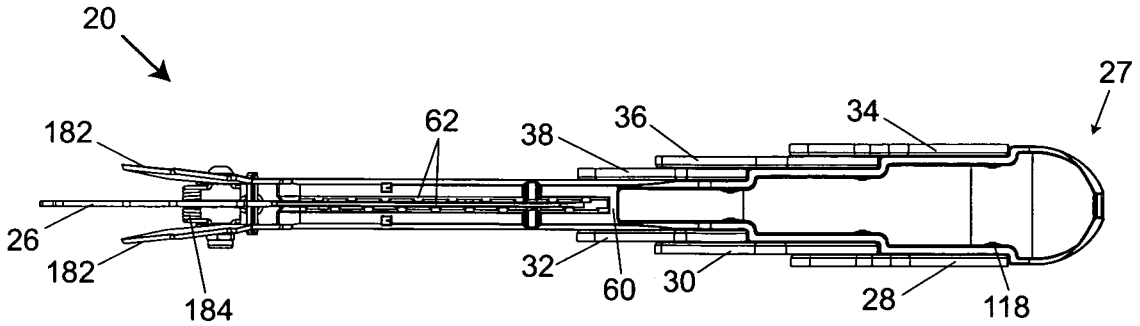
FIG. 6 shows a bottom view of the blade guard in FIG. 2.
Figure 7:
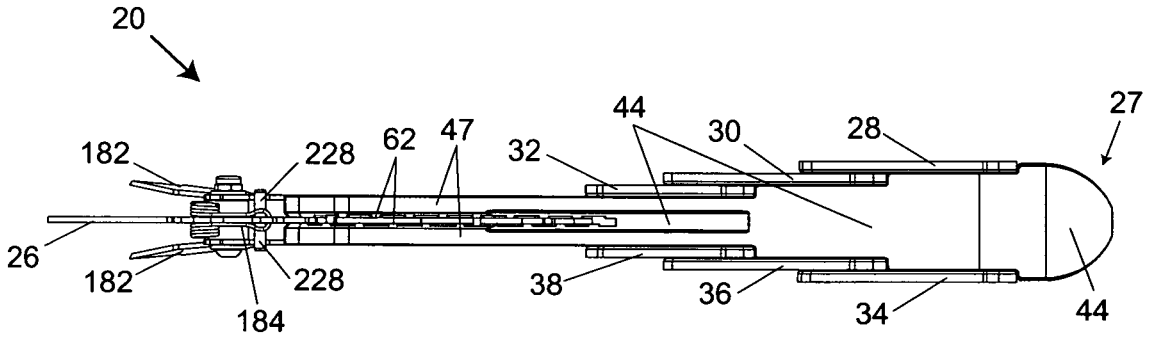
FIG. 7 shows a top view of the blade guard in FIG. 2.

As shown in FIGS. 4 and 10, anti-kickback pawls 182 are attached at the top, rear of the splitter by spring 184 and bolt 186. Splitter 26 includes an extension 214 with a notch 216 (labeled in FIG. 21). Loop 202 of spring 184 hooks around and over extension 214 so that the loop fits in notch 216, as shown in FIG. 5. Splitter 26 also includes a cutout 222 immediately rearward of extension 214, and the cutout includes a notch 220. Bushing 190 in pawl assembly 200 fits into notch 220 so that groove 218, formed by the center thin section 192 in the center of bushing 190, fits over the edge of the splitter along notch 220. The distance between notches 216 and 220 causes spring 184 to stretch, and the tension in the spring holds the pawl assembly on the splitter.

Figure 33:
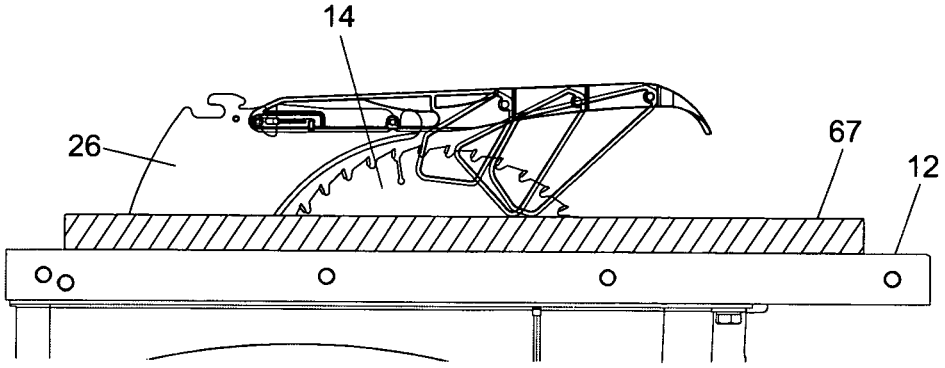
FIG. 33 shows a side view of the blade guard of FIG. 2 installed in the table saw of FIG. 1 in a standard position with a piece of wood being cut and anti-kickback pawls removed.

FIG. 33 shows the blade guard with the anti-kickback pawls removed. To remove the anti-kickback pawl assembly, the user holds both sides of bolt 186 and pulls the bolt back stretching spring 184 until the bolt clears notch 220. Cutout 222 includes an opening 224 large enough for bolt 186 to pass through, so when bolt 186 clears notch 220, the user can lift the bolt up and out of opening 224. Splitter 26 includes an extension 226 defining a rearward edge of cutout 222. Extension 226 helps direct the movement of the anti-kickback assembly as it is being removed or installed.

To re-install the anti-kickback pawl assembly, loop 202 is fitted over extension 214 and center groove 218 of bushing 190 is positioned over the top edge of the splitter. Bolt 186 is then pulled back, stretching spring 184, and moved into cutout 222 through opening 224. The top and bottom edges of extension 214 and cutout 222 are rounded to facilitate movement of the bushing into the cutout. The bolt is then released and spring 184 pulls the bolt into notch 220 and the remaining tension in the spring holds the anti-kickback assembly in place.

In normal operation, spring 184 pulls the anti-kickback pawls down and forward until the front edge of each anti-kickback pawl contacts a pawl stop 228 on the splitter. Pawl stop 228 consists of a small metal cylinder press-fit into the splitter. When a piece of wood, or other workpiece, passes through the blade guard, the anti-kickback pawls rotate back so that the bottom of the pawls ride gently on the surface of the workpiece. As the anti-kickback pawls rotate back, the distance between notch 216 at the top of splitter 26 around which the loop 202 of spring 184 is anchored, and holes 212 through which the ends 210 of spring 184 pass in the anti-kickback pawls, increases and spring 184 is stretched. The resulting tension in the spring creates the restoring force that causes the anti-kickback pawls to rotate forward again after the workpiece leaves the blade guard. However, because coils 204 are not fixed, the top of spring 184 is able to pivot upwards about notch 216 and towards the front of the blade guard as spring 184 is stretched thus reducing the tension in the spring from what it would have been if coils 204 were fixed. That is, because of the geometry of the spring, the distance between notch 216 (which may also be referred to as an anchor point) and holes 212 is less as the anti-kickback pawls rotate back than it would have been if coils 204 were held at a fixed position and holes 212 were at a set distance from the fixed position of the coil. This results in a reduced restoring force by the spring. Not only is the restoring force reduced for this configuration but the difference is greater the more the anti-kickback pawls rotate back. A reduced restoring force helps to minimize marks or visible impressions that the tips of the anti-kickback pawls might otherwise leave on workpieces.

Figure 34:
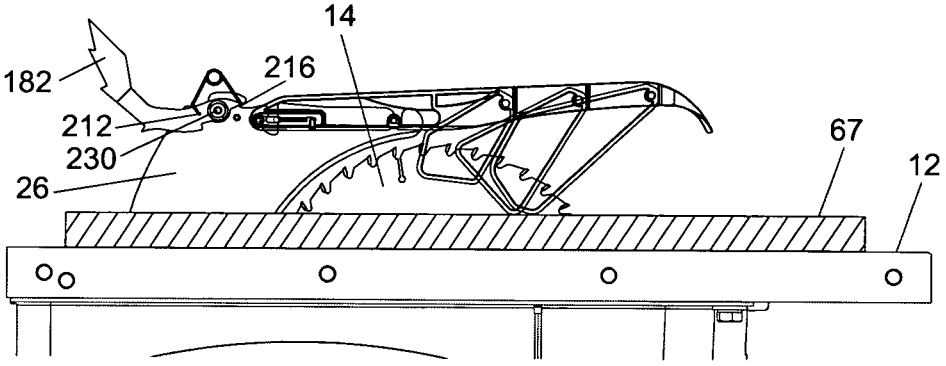
FIG. 34 shows a side view of the blade guard of FIG. 2 installed in the table saw of FIG. 1 in a standard position with anti-kickback pawls in a position of unstable equilibrium.
Figure 35:
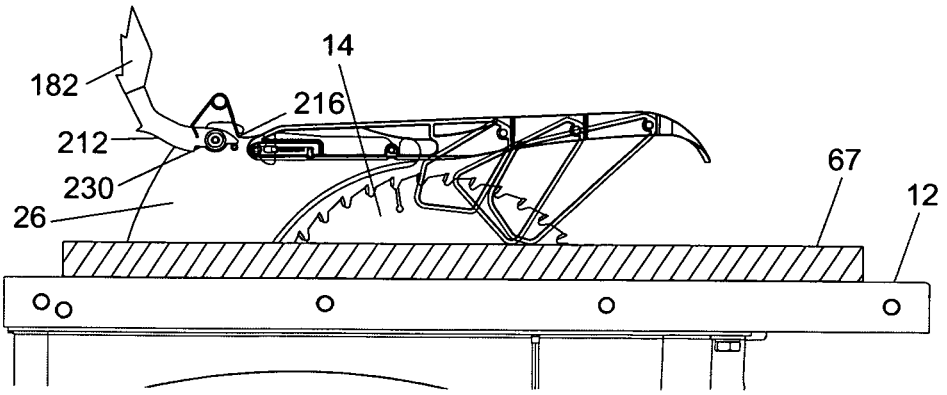
FIG. 35 shows a side view of the blade guard of FIG. 2 installed in the table saw of FIG. 1 in a standard position with a piece of wood being cut and anti-kickback pawls disabled.

The geometry of spring 184 also allows the anti-kickback pawls to be easily disabled simply by rotating the pawls upward to a stable position. When the anti-kickback pawls are rotated back, the tension in the spring increases as the distance between anchor point 216 and each hole 212 increases, and reaches its maximum when anchor point 216 and hole 212 are in line with pivot axis 230 at the center of bolt 186 when viewed from the side, as shown in FIG. 34, which is a point of unstable equilibrium. When the anti-kickback pawls, and thus holes 212, are rotated down below this centerline going through anchor point 216 and pivot axis 230, spring 184 pulls the anti-kickback pawls downward until they contact the surface of the workpiece or stops 228. However, if the anti-kickback pawls are rotated upward beyond this centerline, that is, when it is "overcenter", spring 184 pulls the anti-kickback pawls upward until stops 232, which are extensions at the top of each anti-kickback pawl, abuts stops 228. The spring then holds the pawls up in a disabled position above the workpiece. FIG. 35 shows the anti-kickback pawls rotated up to a stable and disabled position.

INDUSTRIAL APPLICABILITY

The blade guards with hold-down capability, splitters, and anti-kickback devices disclosed herein are applicable to woodworking power tool equipment, and particularly to table saws.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. No single feature, function, element or property of the disclosed embodiments is essential to all of the disclosed inventions. Similarly, the recitation of "a" or "a first" element, or the equivalent thereof, should be understood to include incorporation of one or more such elements, neither requiring nor excluding two or more such elements.

It is believed that the following claims particularly point out certain combinations and sub-combinations that are directed to disclosed inventions and are novel and non-obvious. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. A table saw comprising:

a table defining a work surface;

a circular blade with teeth around its periphery, where the blade is adjustable to extend at least partially above the work surface to an elevation, and where a user can adjust the elevation of the blade;

a splitter configured to move with the blade as the user adjusts the elevation of the blade;

a top guard selectively securable in place on the splitter in a non-hold-down position and in a hold-down position, where in the non-hold-down position the top guard is above the blade and there is a gap between the blade and the top guard, where in the hold-down position the blade protrudes up into the top guard so that the user can adjust the elevation of the blade so that the top guard contacts a workpiece on the work surface as the workpiece is moved into the blade, thereby holding the workpiece down against the table, while the blade extends above the workpiece to cut through the workpiece, where the top guard is flipped over to go from the non-hold-down position to the hold-down position, and where in both the non-hold-down position and the hold-down position the position of the top guard relative to the blade does not change if a user adjusts the elevation of the blade; and side guards pivotally attached to the top guard, where the side guards are configured so that they can pivot down to block the user's hand from moving into at least some of the teeth of the blade when the top guard is in the non-hold-down position and the hold-down position.

2. The table saw of claim 1, where the top guard includes a recess to receive at least part of the blade when the top guard is in the hold-down position.

3. The table saw of claim 1, where the top guard includes an opening sized to receive at least a portion of the splitter.

4. The table saw of claim 1, where the splitter includes two, spaced-apart notches used to secure the top guard in place on the splitter.

5. The table saw of claim 4, further comprising two pins configured to fit within the two, spaced apart notches, and at least one spring configured to hold at least one of the pins in one of the notches.

6. The table saw of claim 1, where the user can change the top guard from the non-hold-down position to the hold-down position without the use of tools.

7. The table saw of claim 1, where the user can change the top guard from the non-hold-down position to the hold-down position without moving a bail or lever.

8. A table saw comprising:

a table defining a work surface;

a circular blade, where the blade is adjustable to extend at least partially above the work surface to an elevation, and where a user can adjust the elevation of the blade;

a splitter configured to move with the blade as the user adjusts the elevation of the blade; and a top guard held securely in place on the splitter so that the top guard does not move along the splitter as a user feeds a workpiece on the work surface past the blade to make a cut, where the top guard is moved forward and rotated upward to remove the top guard from the splitter, and where a user can remove the top guard from the splitter by hand without the use of tools and without moving a bail or lever.

9. The table saw of claim 8, where the top guard includes an opening sized to receive at least a portion of the splitter.

10. The table saw of claim 8, where the splitter includes two, spaced-apart notches used to secure the top guard in place on the splitter.

11. The table saw of claim 10, further comprising two pins configured to fit within the two, spaced apart notches, and at least one spring configured to hold at least one of the pins in one of the notches.

12. The table saw of claim 11, where the two pins are spaced apart, where the spacing between the pins is changeable, and where the spring biases one pin toward the other pin.

* * * * *